US006621385B1

(12) United States Patent
Jain

(10) Patent No.: US 6,621,385 B1
(45) Date of Patent: Sep. 16, 2003

(54) BIAS FEED NETWORK ARRANGEMENT FOR BALANCED LINES

(75) Inventor: Nitin Jain, San Diego, CA (US)

(73) Assignee: M/A-Com, Inc., Lowell, MA (US)

( * ) Notice: Subject to any disclaimer, the term of this patent is extended or adjusted under 35 U.S.C. 154(b) by 0 days.

(21) Appl. No.: 10/116,091

(22) Filed: Apr. 3, 2002

(51) Int. Cl.[7] ..... H01P 3/06
(52) U.S. Cl. ..... 333/247; 455/333
(58) Field of Search ..... 333/236, 238–240, 333/245–248; 455/127, 128, 333

(56) References Cited

U.S. PATENT DOCUMENTS 5,752,182 A * 5/1998 Nakatsuka et al. ..... 455/333

* cited by examiner

*Primary Examiner*—Kenneth B. Wells

(57) ABSTRACT

A circuit configuration for introducing bias in balanced lines capable of high frequency operation includes top and bottom layers formed on a semiconductor substrate. The circuit includes two balanced metallized lines positioned on the substrate. Each metallized line has a serpentine line configuration connected thereto. The space between the lines is a virtual ground. The serpentine line configurations are congruent with the elements on the substrate layers to provide a completed circuit. The elements are coupled to a central metallic area, which in turn is coupled to a bias line through an open-line stub, which extends beyond the virtual ground and which provides equal capacitive coupling to the balanced lines on the top surface. In this manner, the balanced line configuration includes capacitors and inductors which are symmetrically distributed and which provide resonance at the designed operating frequency. The bias line thus formed is RF grounded due to the virtual ground and is disconnected from the actual balanced lines.

20 Claims, 5 Drawing Sheets

BIAS FEED NETWORK ARRANGEMENT FOR BALANCED LINES

FIELD OF INVENTION

This invention relates to balanced line circuits and more particularly to a bias feed network for a balanced line circuit.

BACKGROUND OF INVENTION

A balanced transmission line or balanced line is basically a transmission line that consists of two conductors which are capable of being operated so that the voltages of the two conductors at any transverse plane are equal in magnitude and opposite in polarity with respect to ground. In this manner, the currents in the two conductors are then equal in magnitude and opposite in direction. A balanced line is typically employed in semiconductor circuits for high frequency operation.

For example, on a lossy substrate, such as silicon, balanced lines are useful for implementing circuits. Such balance transmission lines prevent magnetic fields from interfering with circuit operation. Balanced lines operate to provide lower losses compared to microstrip (MS) or coplanar waveguide (CPW) structures on conductive silicon. In fabricating silicon integrated circuits, via-holes through the silicon substrate are not employed. Such via-holes are employed in gallium arsenide (GaAs) substrates and other substrates to enable one to go from the top surface of a circuit substrate to a bottom surface of the circuit substrate or from one layer to another. In silicon, via-holes in the silicon substrate (unlike gallium arsenide substrates) do not exist and since the balanced lines do not require via-holes, they are ideal for use in lossy silicon substrates. The operation of the balanced line minimizes interference.

SUMMARY OF THE INVENTION

There is disclosed a circuit configuration for introducing bias in balanced lines capable of high frequency operation. The circuit configurations are positioned on top and bottom layers formed on a semiconductor substrate. The circuit includes two balanced metallized lines positioned on the substrate. Each metallized line has a serpentine line configuration connected thereto. The space between the lines is a virtual ground. The serpentine line configurations are congruent with the elements on the substrate layers to provide a completed circuit. The elements are coupled to a central metallic area, which in turn is coupled to a bias line through an open-line stub, which extends beyond the virtual ground and which provides equal capacitive coupling to the balanced lines on the top surface. In this manner, the balanced line configuration includes capacitors and inductors which are symmetrically distributed and which provide resonance at the designed operating frequency. The bias line thus formed is RF grounded due to the virtual ground and is disconnected from the actual balanced lines. The positioning of the circuit enables excellent isolation at the designed operating frequency. The circuit configuration is relatively small and compact and can be used in conjunction with lossy substrates to provide optimum balancing of such lines.

DETAILED DESCRIPTION OF THE INVENTION

Figure 1:
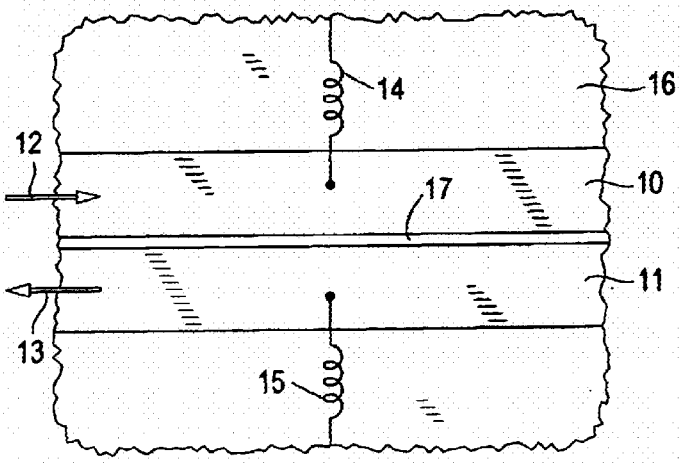
FIG. 1 PRIOR ART
FIG. 1 is a typical prior art configuration showing a prior art balanced line with a conceptual feed.

Referring to FIG. 1, there is shown a prior art configuration of a typical balanced line configuration. The balanced line comprises lines or conductors 10 and 11. A current in conductor 10 flows in the direction of arrow 12, while the current in conductor 11 flows in the direction of arrow 13. The currents flow in equal and opposite directions. The balanced lines 10 and 11 each have a current of the same magnitude, but are 180° out of phase. The wave is confined between the lines. Since the lines are 180° out of phase, the center area 17 between these two lines is a virtual ground. As seen, there are two inductors 14 and 15 associated with each line. The inductors are of equal value. Each inductor is located in a central position to provide a symmetrical circuit.

A bias-feed is often required for balanced lines, which can be used to bias power amplifiers, differential amplifiers and other devices. Typically, very high value inductor chokes or coils are provided that are RF isolated by DC connected to ground. The DC ground is usually positioned on the substrate. These are represented in FIG. 1 as coils 14 and 15. The RF potential on the DC ground in the silicon substrate is not the same as the RF ground 17, which is between the lines. At high frequencies, RF chokes are difficult to make due to self-resonance of the chokes. As a result, the RF potentials in the silicon ground on the side of the balanced lines produces an unsatisfactory unbalanced condition. In this manner, spurious resonance and isolation problems occur due to the positioning of the RF chokes 14 and 15. At millimeter wave frequencies, the spurious response can be so severe that the signal at the frequency of interest is adversely affected. Thus, the prior art balance lines as shown at FIG. 1 utilizing prior art biasing can produce significant problems at high frequencies.

An improved apparatus and method for introducing bias in a balanced line is desired.

Figure 2A:
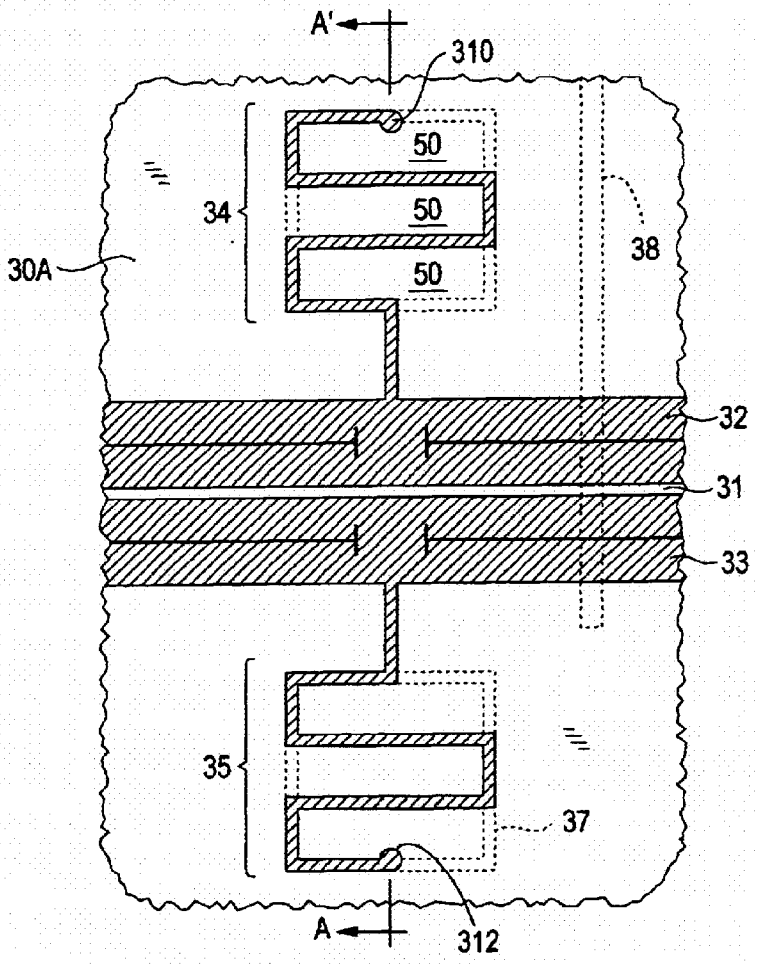
FIG. 2A shows a top layer of a novel biased-feed network according to an aspect of the present invention.
Figure 2B:
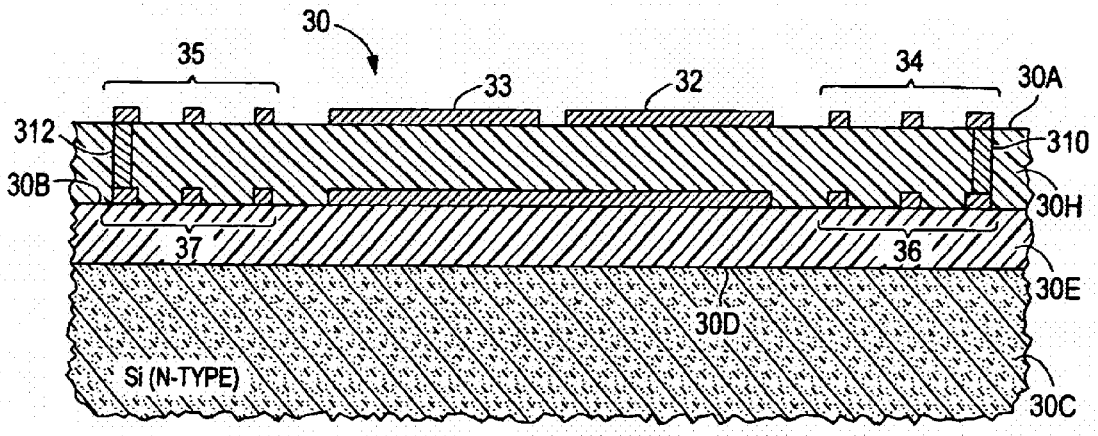
FIG. 2B shows a cross-sectional view along AA' in FIGS. 2A and 2C.
Figure 2C:
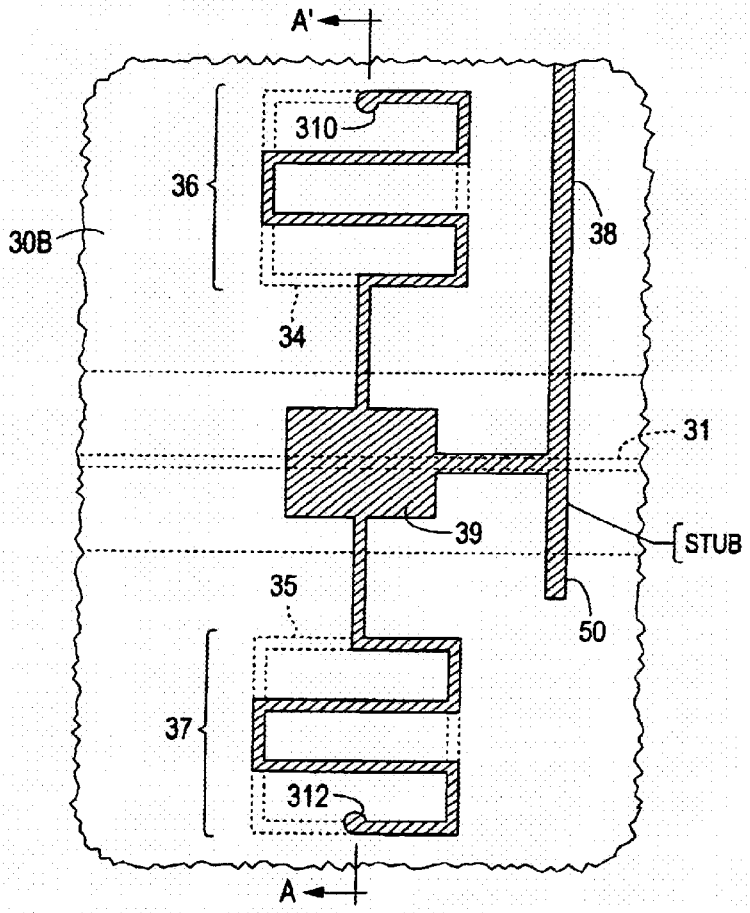
FIG. 2C is the layer incorporating structure, which is on a bottom layer of the substrate of FIG. 2B and therefore positioned below the layer depicted in FIG. 2A.

Referring now to FIG. 2B, there is shown a cross-sectional view along AA' in FIGS. 2A and 2C according to the present invention. As shown therein, substrate 30 can be fabricated from a semiconductor material such as silicon and essentially comprises a wafer or layer of silicon or other semiconductor material having a top surface 30A, a bottom surface 30B and substrate base 30C. Shown in FIG. 2A is a balance line circuit configuration according to an aspect of the invention. The balanced line circuit is placed on top surface 30A by way of example. It is, of course, understood that the top surface 30A can be interchanged with the bottom surface and there is no particular desired orientation, with the exception that the circuit is balanced and layers are positioned one above the other.

As illustrated in FIG. 2B, substrate base 30C of silicon has a layer 30E of $SiO_2$ or SiN deposited thereon. The layer has a bottom surface 30D and a top surface 30B. Deposited on top of the dielectric layer 30E is another layer 30H of dielectric material of $SiO_2$ or SiN, for example, having top surface 30A. This surface has metal areas formed which include the lines 32 and 33, and coils 34, 35 which are connected through vias 310, 312, respectively to coils 36, 37 on surface 30B. As best seen in FIG. 2A, the two conductive lines designated as 32 and 33 are balanced lines and each line will carry a current in opposite directions or currents that are 180° out of phase, as explained in conjunction with FIG. 1. Thus, lines 32 and 33 are equivalent to lines 10 and 11 of FIG. 1. The virtual ground for the circuit is shown at the centerline 31 between the lines 32 and 33. On the top portion of the circuit shown in FIG. 2A, there is a serpentine or sinuous coil configuration 34. Coil configuration 34 has a number of turns shown basically as a square wave type configuration, but any suitable symmetrical configuration can be employed as well. Configuration 34 is basically an inductance, and is electrically coupled or connected to line 32. In a similar manner, a mirror image structure 35, also serpentine in nature, is connected or coupled to line 33. Structure 35 basically has the same pattern and configuration as the structure 34 connected to line 32.

FIG. 2C is an exemplary illustration of the bottom surface or underlying layer of the substrate below the layer depicted in FIG. 2A. The structure of FIG. 2C does not include transmission lines 32 and 33, but is a serpentine coil 36 of a similar configuration to coil 34, but directed in an opposite direction. In a similar manner, the coil 36 is connected to a central metallic area or pad 39, which is also connected to a corresponding coil 37, which again is of a similar configuration to coil structure 35. The area 39 is connected to bias line 38, which essentially has a portion directed underneath the virtual ground 31. As shown now in FIGS. 2A and 2C, when the structures are placed on the top layer 30A and the bottom layer 30B of the surface of the substrate, the coils are positioned to overlap one another. The bottom coil portion is connected to the top coil portion by the via to complete the coil configuration. Coil 34 and coil 36 are connected through via 310 (see FIG. 2A, 2C). Similarly, coil 35 and coil 37 are also connected through via 312. (See FIG. 2A, 2C). The configuration basically shows three closed rectangular areas, separated one from the other by the substrate. Thus, in FIG. 2A the dashed lines represent, for example, the coil 37 which is on the bottom surface 30B of the substrate. In a similar manner, as shown in FIG. 2C, the dashed lines represent coil 35, which overlies coil 37 to form the circuit configuration as shown. As can be seen, virtually the entire top and bottom coils form a closed pattern consisting of three rectangles 50. It is, of course, understood that three is only by way of example. As one can also see from these figures, area 39 is positioned as underlying the central portion of both lines 32 and 33.

Figure 3:
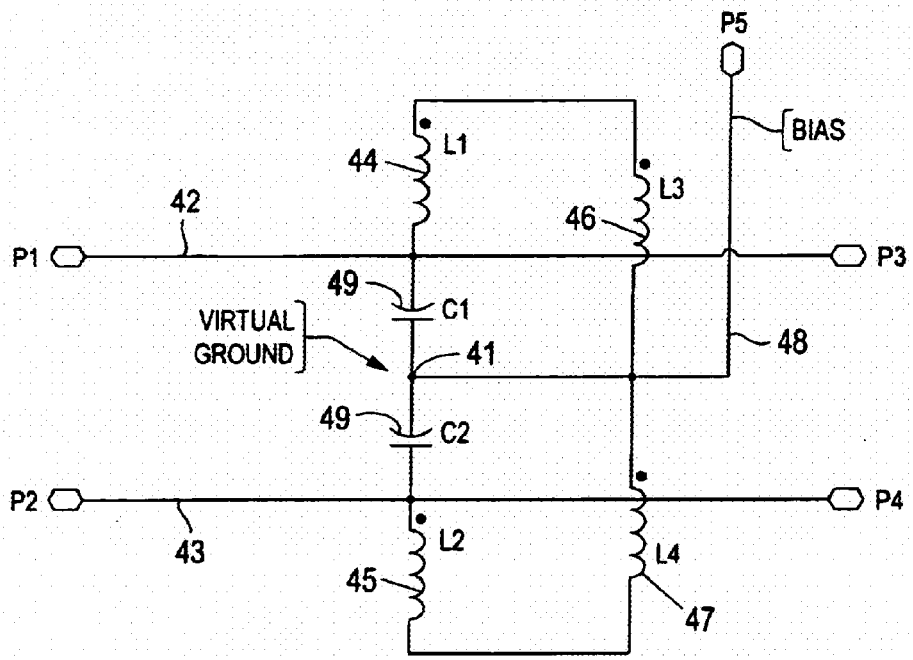
FIG. 3 is a circuit schematic of the structures shown in FIGS. 2A and 2C and showing the bias line and the balanced circuit in conjunction with the virtual ground.

The structures shown in FIGS. 2A–2C are implemented on silicon by typical metallization techniques, which include CVD sputtering, electron beam evaporation or other deposition techniques to deposit metal structures on a silicon substrate. Referring to FIG. 3, there is shown an equivalent circuit for the circuit configuration shown in FIGS. 2A–2C. The serpentine structures 34 and 36 in FIG. 2A are high impedance lines and are represented in FIG. 3 as lumped inductors 44 and 46. In a similar manner, the structures in FIG. 2C, namely serpentine structures 35 and 37, are also high impedance lines and are indicated in FIG. 3 as lumped inductors 45 and 47. The lines 32 and 33 in FIG. 2A are depicted as lines 42 and 43 in FIG. 3.

It is noted that the line structures 34, 35, 36 and 37 (FIG. 2A) are high impedance lines directed away from the virtual ground 31 of FIG. 2A and coupled to the balanced lines 42 and 43 of FIG. 3. These lines, therefore, have very low magnetic flux directed through them due to the balanced circuit arrangement. The metal area 39 represents a conductive component which is coupled to both of the balanced lines 32 and 33. This is represented in FIG. 3 by the capacitors 49 and designated as C1,C2. The capacitor may be split into two equal capacitors (i.e. C1=C2) because of the virtual RF ground between each of the lines as formulated in FIGS. 2A and 2C. Finally, the line 38 in FIG. 2C represents the bias line 48 of FIG. 3. The line 48 is connected to the virtual ground 41, which is the virtual ground 31 of FIG. 2A. The open circuit line stub 50 in FIG. 2C and FIG. 3 extends beyond the virtual ground to provide equal capacitive coupling to the balanced lines 32 and 33 of FIG. 2A, or lines 42 and 43 of FIG. 3. The performance of the circuit is easily understood by referring to FIG. 3. The capacitance is resonant with the inductor at the designed frequency. The bias is RF grounded due to the virtual ground and is disconnected from the lines. These two mechanisms together give excellent isolation at the design frequency of operation.

Figure 4:
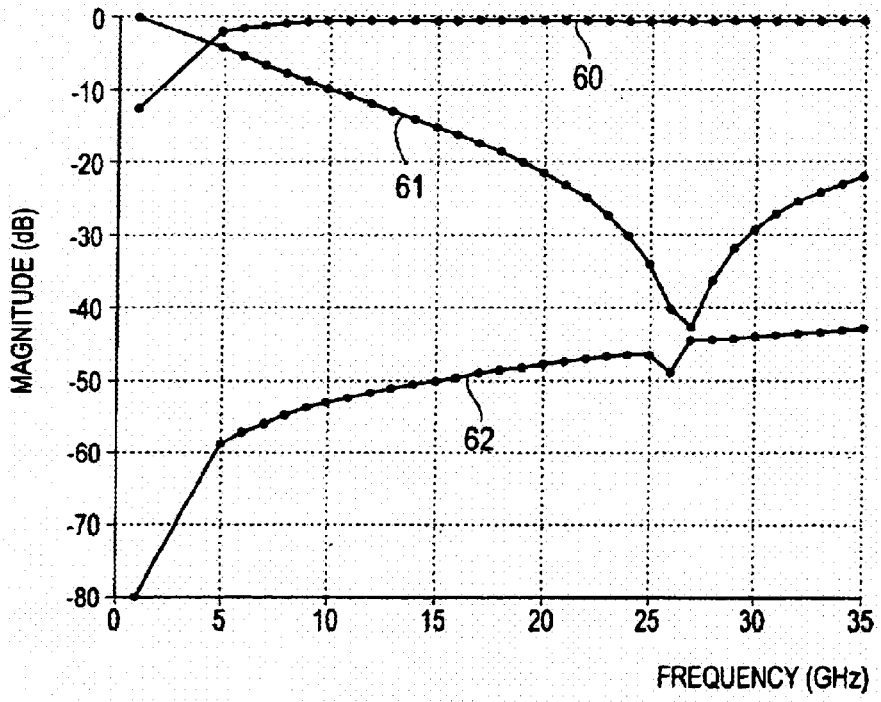
FIG. 4 is a plot showing the frequency and magnitude depicting operation of the circuit shown in FIGS. 2A through 2C.

Referring to FIG. 4, there is shown the performance of the balanced line configuration depicted in FIG. 2 (and FIG. 3). In FIG. 4, the curve 60 represents the magnitude of the balanced signal that goes through, while curve 61 shows the signal that is reflected due to the bias network. Additionally, the curve 62 shows the isolation between the biased line and the balanced RF line. FIG. 4 shows that continuities are matched at the desired band of 20 to 35 GHz, where the return loss is better than 20 dB. The isolation between the bias line and the RF signal is better than 40 dB across the entire band. While a preferred surface configuration has been shown in FIG. 2A and 2C to implement the above configurations, it should be understood to one skilled in the art-that there are a number of other possibilities which can function and which are equivalent to the configurations of 2A and 2C.

Figure 5:
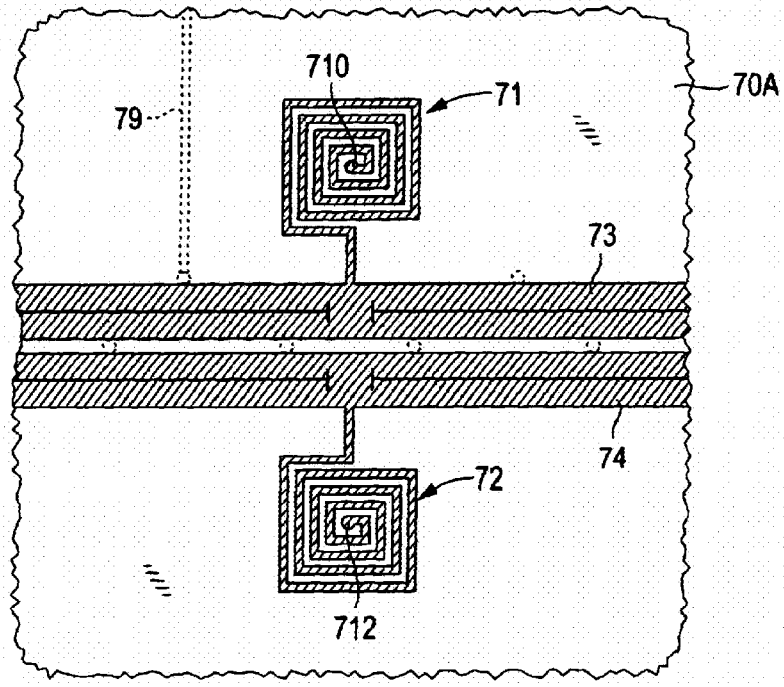
FIG. 5 is a top view of an alternate embodiment of a balanced circuit which is positioned on a substrate.
Figure 6:
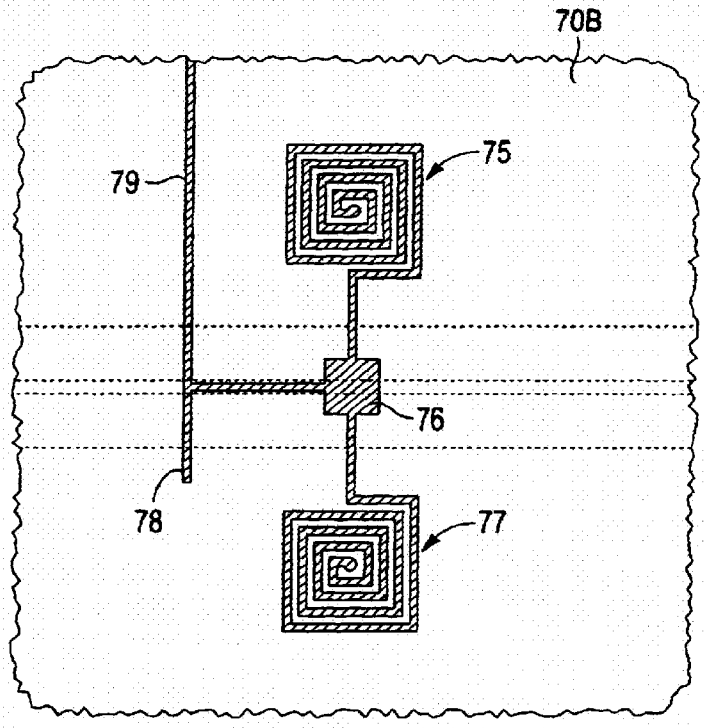
FIG. 6 is a corresponding bottom layer showing the layer or circuit below the top layer shown in FIG. 5 positioned on the same substrate.
Figure 7:
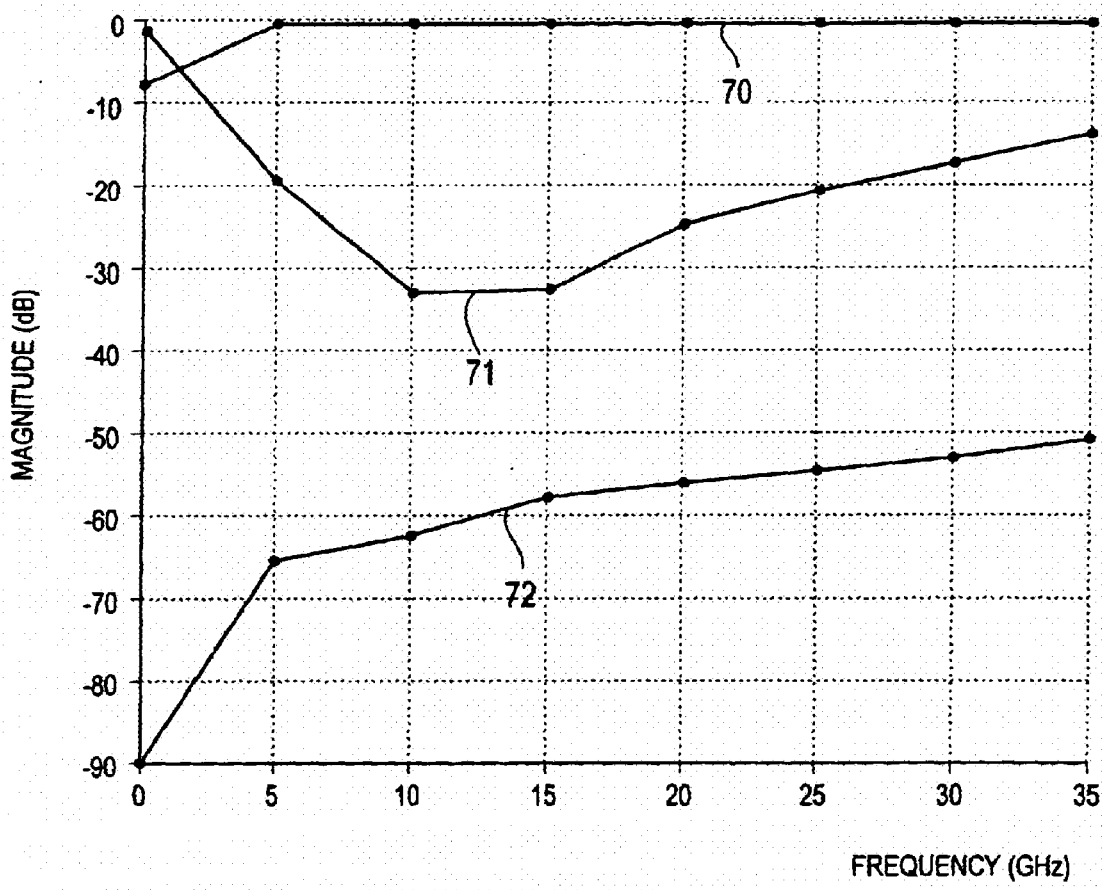
FIG. 7 is a graph depicting the performance of the structure shown in FIG. 5 and FIG. 6.

Referring to FIGS. 5 and 6, there is shown an alternate embodiment according to an aspect of the present invention. FIG. 5 shows the top layer 70A of substrate 70, which has located thereon balanced lines 73 and 74. Each balanced line is again coupled to a loop or a coil configuration which is a serpentine configuration comprising a complete loop or coil. The bottom layer 70B of substrate 70 shown in FIG. 6 again has complementary serpentine configurations 75 and 77 which essentially complete the circuit configurations 71 and 72 by means of vias 710, 712 and hence, close the configurations in a manner similar to the structure shown in FIGS. 2A and 2C. Layer 70B is beneath layer 70A, as the configuration comprises layers on a substrate, analogous to that shown in FIGS. 2A–2C. Each of the lines 75 and 77 are connected to the centralized conductive metal plate 76, which is associated with the bias line 79 and the circuit line stub 78. The structure shown in FIGS. 5 and 6 may be represented by the same equivalent circuit structure shown in FIG. 3. However, the simulated response is wider with frequency than that of the structure depicted in FIGS. 2A and 2C. The structure shown in FIGS. 5 and 6 operates at 5 to 25 GHz. FIG. 7 shows the performance provided by that circuit configuration. FIG. 7 depicts an EM simulation S parameter for the structures shown in FIGS. 5 and 6. This is a plot of signal propagation versus frequency. In FIG. 7, curve 70 represents the magnitude of the balanced signal that goes through, while curve 71 shows the signal that is reflected due to the bias network. Additionally, curve 72 shows the isolation between the biased line and the balanced RF line. For extremely broadband applications, the bias network could also employ a series resistor or ferrite choke that would enable operation at lower frequencies. With the availability of a good RF bias at high frequencies and with a good RF choke at lower frequencies, one can implement DC to millimeter wave frequency RF biasing networks using a single bias point. Thus, the configuration depicted demonstrates excellent isolation for broadband operation. As one can see, the circuit has many applications in the millimeter region and for broadband operation. Circuits can be used to bias high-speed switches, while the circuit allows for low parasitic network operation enabling circuits to develop transient responses.

Thus, a circuit configuration for introducing bias in balanced lines capable of high frequency operation comprises top and bottom layers formed on a semiconductor substrate. The circuit includes two balanced metallized lines positioned on the substrate. Each metallized line has a serpentine line configuration connected thereto. The space between the lines is a virtual ground. The serpentine line configurations are congruent with the elements on the substrate layers to provide a completed circuit. The elements are coupled to a central metallic area, which in turn is coupled to a bias line through an open-line stub, which extends beyond the virtual ground and which provides equal capacitive coupling to the balanced lines on the top surface. In this manner, the balanced line configuration includes capacitors and inductors which are symmetrically distributed and which provide resonance at the designed operating frequency. The bias line thus formed is RF grounded due to the virtual ground and is disconnected from the actual balanced lines.

It is, of course, understood in the art that balanced circuits such as those shown in the above-noted operation are employed for high frequency operations and can particularly be used on silicon substrates as described above. It is also ascertained that the circuits are simple to fabricate using conventional fabrication techniques. Circuit operation is repeatable and reliable in all respects.

What is claimed is:

1. A balanced line network for use with lossy semiconductor substrates, comprising:

first and second spaced apart parallel balanced conductive lines directed from a first end to a second end of said substrate and positioned on a top surface of said substrate, each line coupled to a symmetrically positioned transverse high impedance line which, as positioned, are shielded by said first and second lines, and are positioned to form first symmetrical inductive reactances for said lines, an insulating layer formed on said substrate and having a metallized area located thereon and symmetrically positioned between said first and second lines and said high impedance lines to provide a balanced capacitive reactance for said lines, said metallized area connected to said symmetrical high impedance lines which are positioned to co-act with said high impedance lines on a top surface of said layer to form second symmetrical inductive reactance for said lines, wherein said inductive reactances and said capacitive reactances resonate at a desired frequency and where the reactances are all referenced to a virtual ground as the space between said parallel balanced lines, and a bias line connected to said virtual ground.

2. The network according to claim 1 wherein said symmetrically positioned transverse high impedance lines each include a serpentine metallized pattern, which patterns are congruent for said first and second lines, and congruent mirror images for said metallized area high impedance lines.

3. The network according to claim 1 wherein said lossy substrate is silicon.

4. The network according to claim 1 wherein said desired frequency is between 20 to 35 GHz.

5. The network according to claim 1 wherein said bias line is a metallized line positioned on a bottom surface of said substrate and transverse to said first and second lines and coupled to said metallized area.

6. The network according to claim 5 wherein said bias line is RF grounded at said desired frequency.

7. The network according to claim 2 wherein said serpentine metallized patterns are square wave shaped patterns.

8. The network according to claim 2 wherein said serpentine metallized patterns are loop patterns.

9. The network according to claim 8 wherein said loop patterns are shaped as spiral loops.

10. The network according to claim 1 wherein said first and second inductive reactances are high impedance lines having very low magnetic flux during network operation.

11. A balanced line network configuration adapted for bias circuit feed, comprising:

a substrate having a top surface and a bottom surface, first and second metallized conductive lines positioned on said top surface relatively parallel to each other and separated by a predetermined distance, a first serpentine structure connected to said first line at a first given point forming a first high impedance element, a second serpentine structure connected at a second given point to said second line forming a second high impedance structure, a metallized area positioned on said substrate and symmetrically positioned about a common point between said first and second lines, a third serpentine structure connected to said metallized area at said common point with respect to said first serpentine structure to provide a first symmetrical inductive reactive element for said first and second lines, and connected to the first serpentine structure, a fourth serpentine structure connected to said metallized area at said common point opposite said first side and positioned with respect to said second top serpentine structure to provide a second symmetrical inductive reactive element for said first and second lines, with said first and second inductive reactive elements coupled together, said metallized area of said substrate providing a symmetrical capacitive reactance between said first and second lines, a virtual ground located at the center of the space between said first and second lines whereby a bias conductive line can be connected to said virtual ground to form a RF bias line for said balanced line network.

12. The network configuration according to claim 11 wherein said first and second serpentine structures are mirror images of said third and fourth serpentine structures.

13. The network configuration according to claim 12 wherein said first and second serpentine structures are metallized structures of square wave patterns extending from said given point in opposite directions from said first and second lines.

14. The network configuration according to claim 13 wherein said third and fourth serpentine structures are mirror image square wave patterns extending from said common point on said opposite sides of said metallized area in corresponding directions and along the paths of said first and second structures.

15. The network configuration according to claim 11 wherein said substrate is fabricated from silicon having at least a first layer of an insulator for accommodating metal patterns.

16. The network configuration according to claim 11 further including a metallized bias line located on said bottom surface and transverse to said first and second lines and coupled to said metallized area as connected to said virtual ground.

17. The network configuration according to claim 11 wherein said first and second serpentine structures are metallized loops.

18. The network configuration according to claim 17 wherein said third and fourth serpentine structures are metallized loops which overlap said loops of said first and second structures, wherein the metallized loops of the third and fourth structures are looped within the spaces between the loops of said first and second structures.

19. The network configuration according to claim 11, said configuration adapted for operation in the 20 to 35 GHz frequency range.

20. The network configuration according to claim 19 wherein the isolation of bias line in said frequency range is at least 40 dB or greater.

* * * * *